United States Patent [19]

Eschenbach

[11] 3,959,992

[45] June 1, 1976

[54] CIRCULAR KNITTING MACHINE WITH ATTACHED STOOL MEMBER

[75] Inventor: Paul W. Eschenbach, Inman, S.C.

[73] Assignee: Deering Milliken Research Corporation, Spartanburg, S.C.

[22] Filed: Apr. 18, 1975

[21] Appl. No.: 569,207

[52] U.S. Cl. ..... 66/8; 312/235 A; 297/217

[51] Int. Cl.[2] ..... D04B 9/00

[58] Field of Search ..... 66/8, 1 R, 147, 149 R, 66/151, 60; 139/13 R, 1 R, 304; 297/217; 312/228, 235, 64

[56] References Cited

UNITED STATES PATENTS

| | | | |
|---|---|---|---|
| 1,491,039 | 4/1924 | Hansen et al. | 312/235 R |
| 2,570,865 | 10/1951 | Sabo | 297/217 X |
| 2,751,768 | 6/1956 | Lebocey | 66/149 R X |
| 3,030,166 | 4/1962 | Richards et al. | 312/235 R |
| 3,330,609 | 7/1967 | Tippett | 312/235 R |
| 3,341,148 | 9/1967 | Cooper | 139/304 |
| 3,590,599 | 7/1971 | Ricart | 66/8 |
| 3,779,041 | 12/1973 | Gati | 66/147 X |
| 3,839,885 | 10/1974 | Bourgeois | 66/151 |
| 3,842,627 | 10/1974 | Bassist | 66/151 |
| 3,850,012 | 11/1974 | Bourgeois | 66/151 |
| 3,855,822 | 10/1974 | Lee | 66/151 |

FOREIGN PATENTS OR APPLICATIONS

| | | | |
|---|---|---|---|
| 626,646 | 10/1961 | Italy | 66/64 |
| 879,983 | 10/1961 | United Kingdom | 139/13 |
| 1,132,170 | 10/1968 | United Kingdom | 139/1 R |

*Primary Examiner*—Louis K. Rimrodt
*Assistant Examiner*—Andrew M. Falik
*Attorney, Agent, or Firm*—H. William Petry

[57] ABSTRACT

A circular knitting machine having a step attached to the machine which is accessible when the machine is in operation but moves out of the way when the knitting machine guard is opened to gain access to the interior of the machine.

7 Claims, 4 Drawing Figures

CIRCULAR KNITTING MACHINE WITH ATTACHED STOOL MEMBER

The object of the invention is to provide a step on a circular knitting machine for use by an operator when the machine is in use but which is readily moved out of the way when it is necessary to gain entrance to the interior of the machine.

Other objects and advantages of the invention will become clearly apparent as the specification proceeds to describe the invention with reference to the accompanying drawings, in which.

Figure 1:
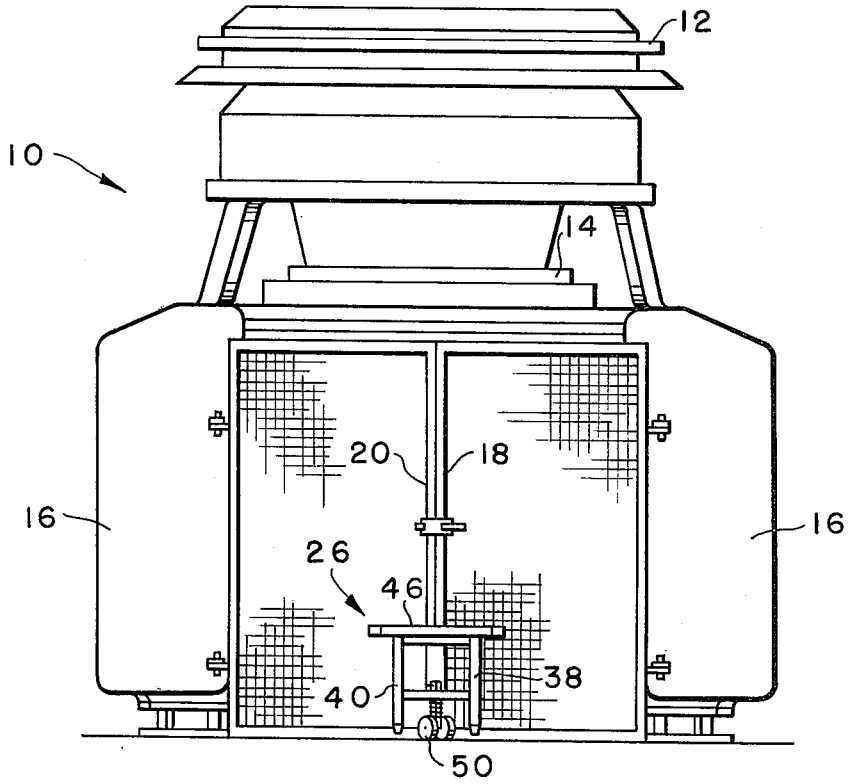
FIG. 1 is a schematic front elevation view of a circular knitting machine which employs a step for use by the machine operator.
Figure 2:
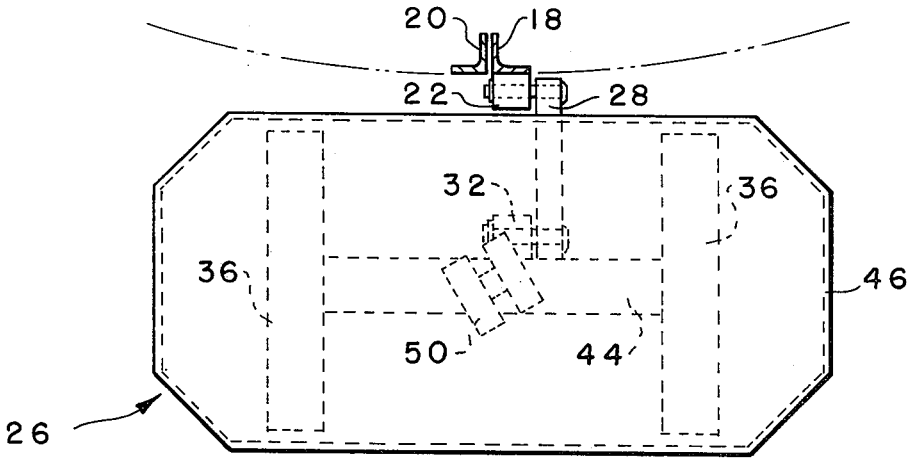
FIG. 2 is a top view of the step shown in FIG. 1.
Figure 3:
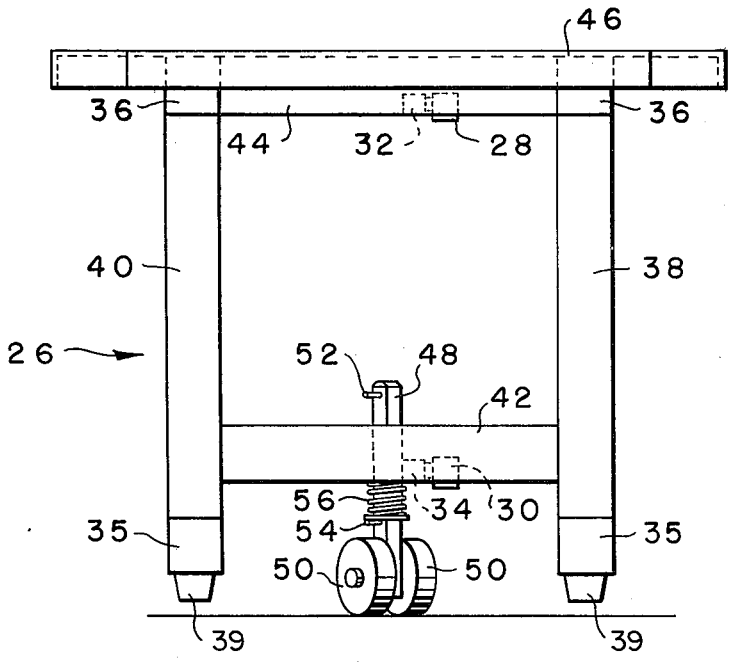
FIG. 3 is a front elevation view of the step shown in FIG. 1.
Figure 4:
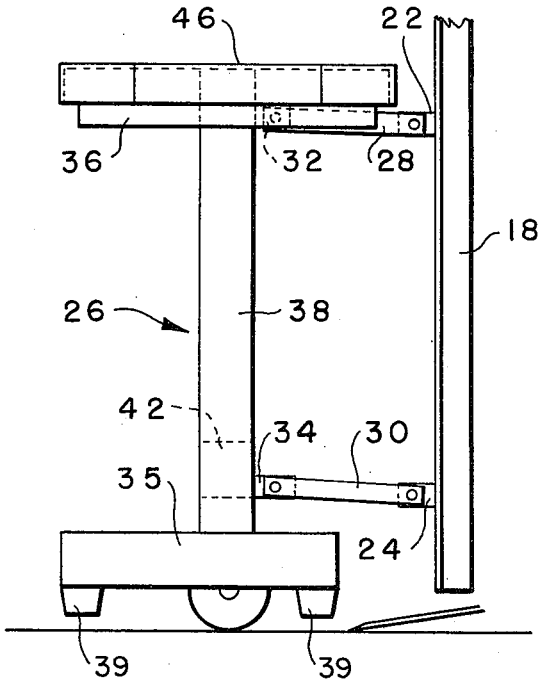
FIG. 4 is a side elevation of the step shown in FIG. 1.

Looking to FIG. 1, the reference numeral 10 represents a conventional circular knitting machine which is supplied with a plurality of yarns from an off-side creel (not shown). The yarn is supplied through the yarn guide ring 12 to the rotating needle cylinder 14 whereat it is knit into a tube of fabric and taken up on a take-up roll located inside the machine. The knitting machine employs a plurality of frame members 16 between which are hinged a pair of screen guard doors 18 and 20 to prevent access to the interior of the machine during operation.

Pivotally mounted to brackets 22 and 24 on the door 18 is a step stool 26 connected to brackets 22 and 24 by lever arms 28 and 30, respectively.

The step stool consists of upper and lower elongated support members 35 and 36 with each of the lower members 35 supporting a plurality of floor contacting feet 39, upright structure members 38 and 40 connected between upper and lower support members 35 and 36, cross-bracing support members 42 and 44 and top 46 to support the feet of the user. Brackets 32 is mounted on the side of cross-brace 44 while bracket 34 is mounted on the side of cross-brace 42.

Slidably mounted in an opening in the cross-brace 42 is a rod member 48 to which a plurality of wheels 50 are attached to at the bottom. A stop pin 52 is located adjacent the top thereof to prevent the wheels and rod member from falling out when the stool 26 is picked up. Adjacent the bottom is another stop pin 54 to position the bottom of spring 56 which is exerting an upward force on the stool through the cross-brace 42 to which it abuts. It should be noted that the axis of the wheels 50 is at an angle to the major and minor axes of the stool 26 for reasons hereinafter explained.

In operation the stool 26 is in the position shown in FIGS. 1–4 with the spring 56 urging the stool upwards to raise the feet 38 off the floor. In this position when the doors 18 and 20 are opened to gain access to the interior of the machine, the stool 26 will readily roll on the wheels 50 as the door 18 pivots open to move the stool out of the way of the machine. It should be noted that the axis of rotation of the wheels is at an angle to the major axis of the stool and intersects the door hinge pin so that the stool will rotate in an angular path.

When the doors 18 and 20 are closed in the position shown in FIGS. 1–4 it can be seen that when a person steps or sits down on the stool 26, the stool will move downward against the bias of spring 56 until the feet 39 contact the floor on which the knitting machine 10 is mounted to stabilize the position of the stool. If desired, the feet can be made of a skid-resistant substance or can be coated with such a substance on the bottom thereof.

It is obvious that a circular knitting machine has been described which incorporates a means to gain access to the upper portions of the machine while in operation, while, at the same time, the means are readily moved when it is necessary to gain access to the interior of the machine.

Although the preferred embodiment of the invention has been described, it is contemplated that changes may be made without departing from the scope or spirit of the invention and it is desired that the invention be limited only by the scope of the claims.

That which is claimed is:

1. A circular knitting machine having a frame and a means to knit a fabric comprising: door means pivotally connected to said frame to permit access to the interior of said machine and a stool means connected to said door means which moves with said door means when said door means is pivoted.

2. The structure of claim 1 wherein said door means includes wheel means adapted to engage the surface on which said knitting machine is mounted.

3. The structure of claim 2 wherein said stool means includes a means to raise said stool means off the surface on which said knitting machine is mounted when said wheel means engage such surface.

4. The structure of claim 3 wherein said means to raise includes a spring means.

5. The structure of claim 4 wherein said stool means includes a stepping member and support means for said stepping member, said support means having an opening therein, a rod means slidably mounted in said opening and said wheel means are mounted on the lower end of said rod means.

6. The structure of claim 5 wherein said spring means surrounds said rod member and is located between said wheel means and said support means.

7. The structure of claim 6 wherein a stop member is connected to said rod member below said spring means.

* * * * *